US007287762B2

(12) United States Patent
Stratton

(10) Patent No.: US 7,287,762 B2
(45) Date of Patent: Oct. 30, 2007

(54) TRUCK FOR SKATEBOARDS

(75) Inventor: Neil Stratton, 706 6th Ave., Venice, CA (US) 90291

(73) Assignee: Neil Stratton, Venice, CA (US)

( * ) Notice: Subject to any disclaimer, the term of this patent is extended or adjusted under 35 U.S.C. 154(b) by 417 days.

(21) Appl. No.: 11/039,617

(22) Filed: Jan. 19, 2005

(65) Prior Publication Data

US 2006/0087087 A1 Apr. 27, 2006

Related U.S. Application Data

(60) Provisional application No. 60/621,407, filed on Oct. 21, 2004.

(51) Int. Cl.
*A63C 17/02* (2006.01)

(52) U.S. Cl. ..... 280/11.27; 280/11.19; 280/87.042

(58) Field of Classification Search ..... 280/11.19, 280/11.25, 11.27, 11.28, 87.01, 87.021, 87.03, 280/87.041, 87.042, 87.043, 87.05
See application file for complete search history.

(56) References Cited

U.S. PATENT DOCUMENTS 4,109,925 A * 8/1978 Williams et al. ..... 280/11.28
4,166,629 A * 9/1979 List ..... 280/11.28
6,428,023 B2 * 8/2002 Reyes et al. ..... 280/87.042
6,467,782 B1 * 10/2002 Smith ..... 280/87.042
6,547,262 B1 * 4/2003 Yamada et al. ..... 280/11.28
6,793,224 B2 * 9/2004 Stratton ..... 280/87.042
7,080,845 B2 * 7/2006 Inchley ..... 280/87.042

* cited by examiner

*Primary Examiner*—Christopher P. Ellis
*Assistant Examiner*—John D Walters
(74) *Attorney, Agent, or Firm*—Tope-Mckay & Associates; Marcus L. Risso

(57) ABSTRACT

A skateboard truck is presented that includes a kingpin situated between a pivot pin and an axle. The truck includes a base plate, with a pivot pin with a tip pivotally attached with the base plate. An axle having a center point is included, where a pin-axle axis runs from the pivot pin tip through the center point. A kingpin couples the axle with the base plate. The kingpin has a midpoint and a length, with a kingpin axis running the length of the kingpin and through the midpoint. The kingpin midpoint is positioned between the axle and the pivot pin, such that a pin-kingpin axis runs from the pivot pin tip through the midpoint of the kingpin. The pivot pin and the axle are configured such that the pin-kingpin axis is between the kingpin axis and the pin-axle axis, providing the skateboard truck movement about two axes of rotation.

23 Claims, 7 Drawing Sheets

100

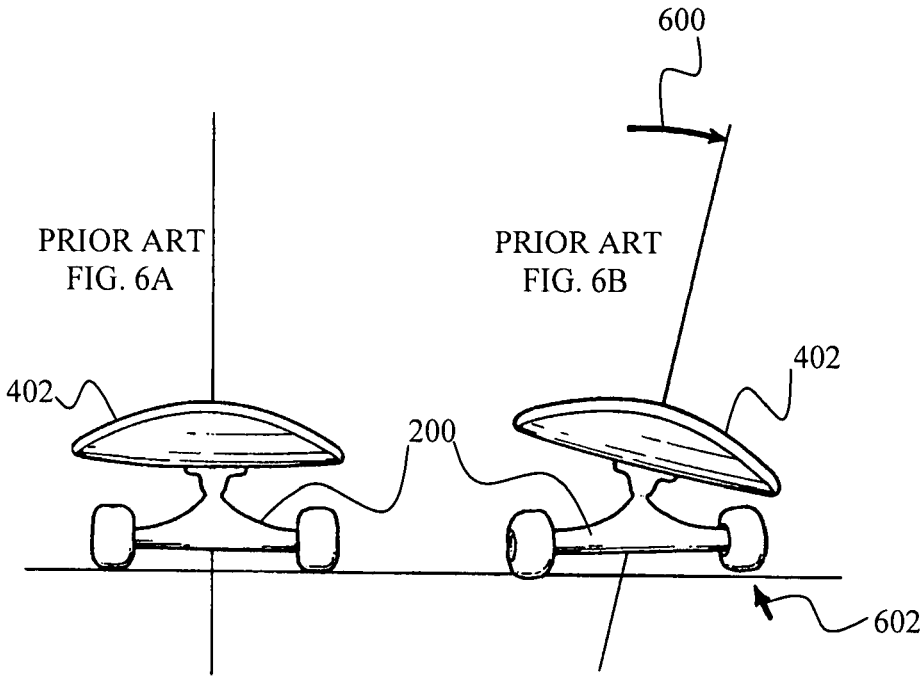
600
PRIOR ART
FIG. 6A
PRIOR ART
FIG. 6B
402
402
200
602
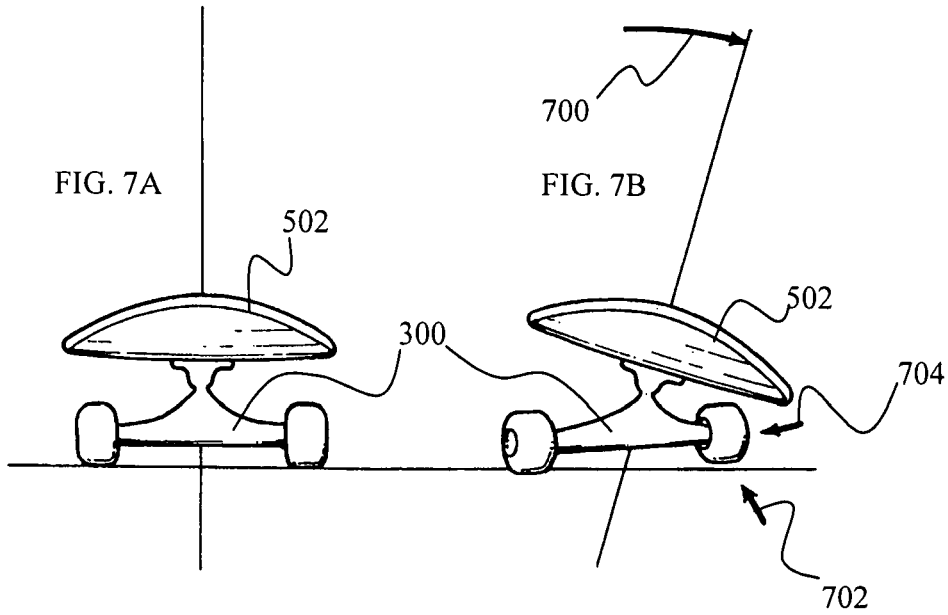
700
FIG. 7A
FIG. 7B
502
502
300
704
702

PRIOR ART

TRUCK FOR SKATEBOARDS

PRIORITY CLAIM

This application is a non-provisional application, claiming the benefit of priority to provisional application No. 60/621,407, filed in the United States on Oct. 21, 2004, and titled "Truck for Skateboards."

BACKGROUND OF THE INVENTION (1) Technical Field

The present invention is directed to an improved truck for a skateboard, all-terrain board or scooter, and more particularly to a truck having a kingpin that is situated between a pivot pin and an axle such that it provides the axle with an increased range of motion about two axes of rotation.

(2) Description of Related Art

Conventional skateboards utilize steering mechanisms known as trucks. Typically, a truck is mounted near each end of the skateboard, and includes a pair of wheels at each end of its axles. The trucks provide some steering response, whereby when a skateboarder shifts weight laterally across the board, the axle twists, causing the board to turn. The trucks also serve, by means of a suspension system (e.g., urethane bushings), to resiliently resist the skater's lateral tilt of the deck, thus stabilizing the board and returning it to its normal position when the turn is completed. This lateral stability is crucial for both distance riding and aerial tricks where a firm platform is desired. Current trucks must sacrifice their ability to turn for lateral stability, thus becoming stiff and unresponsive when tightened sufficiently. Conversely, loosening the trucks so the board can turn easily makes it dangerously wobbly, especially at higher speeds. Furthermore, even in optimal conditions, the rate of turn provided by conventional trucks is minimal.

Previous attempts have been made to design a truck with increased maneuverability. One method utilizes a truck having a trailing castor that provides the skateboard with a second axis of rotation, as described in U.S. Pat. No. 6,793,224, issued to Stratton. As taught by the Stratton invention, the truck comprises a conventional truck mounted to a pivotal member. The pivotal member is coupled to the nose of the deck about a bearing plate which rotates along an angled plane. The rotation of this member is regulated by an adjustable spring-loaded linkage. However, a drawback of this design is the complexity of construction and the increased number of components that are susceptible to wear and breakage.

Accordingly, a need exists for an improved truck that provides the user with more torsional movement of the pivoting member and is adjustable for users of varying needs, without complex components.

SUMMARY OF THE INVENTION

The present invention relates to a skateboard truck. The skateboard truck comprises a base plate with a base for attaching with a skateboard deck. A pivot pin with a tip is pivotally attached with the base plate. An axle is connected with the pivot pin. The axle has a center point, where a pin-axle axis runs from the pivot pin tip through the center point of the axle. A kingpin couples the axle with the base plate. The kingpin has a midpoint and a length, with a kingpin axis running the length of the kingpin and through the midpoint. The kingpin midpoint is positioned between the axle and the pivot pin, such that a pin-kingpin axis runs from the pivot pin tip through the midpoint of the kingpin. A resilient bushing set is circumferentially disposed about the kingpin for providing a skateboard truck pivot axis. The pivot pin and the axle are configured such that the pin-kingpin axis is between the kingpin axis and the pin-axle axis, providing the skateboard truck movement about two axes of rotation.

In another aspect, the kingpin is positioned such that it would be substantially perpendicular to an attached skateboard deck.

In yet another aspect, each of the pin-to-kingpin and pin-to-axle axes are inclined at an angle relative to an attached skateboard deck, such that an angle of the pin-to-kingpin axis is greater than the angle of the pin-to-axle axis relative to an attached skateboard deck.

In another aspect, the kingpin is positioned at an angle ranging from about 70° to about 105° relative to an attached skateboard deck.

In yet another aspect, the pin-to-axle axis is inclined at an angle ranging from about 35° to about 55°.

Furthermore, the pin-to-kingpin axis is inclined at an angle ranging from about 40° to about 70°.

In yet another aspect, the present invention also includes a skateboard. The skateboard comprises a skateboard deck with two skateboard trucks attached thereto. One of the skateboard trucks is the skateboard truck of the present invention, while the other is a traditional skateboard truck.

Finally, as can be appreciated by one in the art, the present invention also comprises a method for forming the skateboard and skateboard truck described herein.

BRIEF DESCRIPTION OF THE DRAWINGS

The objects, features and advantages of the present invention will be apparent from the following detailed descriptions of the preferred aspect of the invention in conjunction with reference to the following drawings where:

FIG. 6A is a front view illustration of a traditional truck, attached with a bottom side of a skateboard;

FIG. 6B is a front view illustration of a traditional truck, attached with a bottom side of the skateboard as shown in FIG. 6A, with lateral deflection of the skateboard;

FIG. 7A is a front view illustration of a truck according to the present invention, attached with a bottom side of a skateboard;

FIG. 7B is a front view illustration of a truck according to the present invention, attached with a bottom side of the skateboard as shown in FIG. 7A, with lateral deflection of the skateboard;

DETAILED DESCRIPTION

The present invention relates to an improved truck for a skateboard, all-terrain board or scooter, and more particularly to a truck having a kingpin that is situated between a pivot pin and an axle such that it provides the axle with an increased range of movement about two axes of rotation.

The following description, taken in conjunction with the referenced drawings, is presented to enable one of ordinary skill in the art to make and use the invention. Various modifications will be readily apparent to those skilled in the art, and the general principles defined herein may be applied to a wide range of aspects. Thus, the present invention is not intended to be limited to the aspects presented, but is to be accorded the widest scope consistent with the principles and novel features disclosed herein. Furthermore it should be noted that unless explicitly stated otherwise, the figures included herein are illustrated diagrammatically and without any specific scale, as they are provided as qualitative illustrations of the concept of the present invention.

(1) Introduction

The present invention enhances the drive and quickness of turning of a skateboard truck, utilizing common and standard components. The present invention combines truck parts into a novel geometry to provide an unexpected result and an improvement upon existing skateboard trucks.

Figure 1:
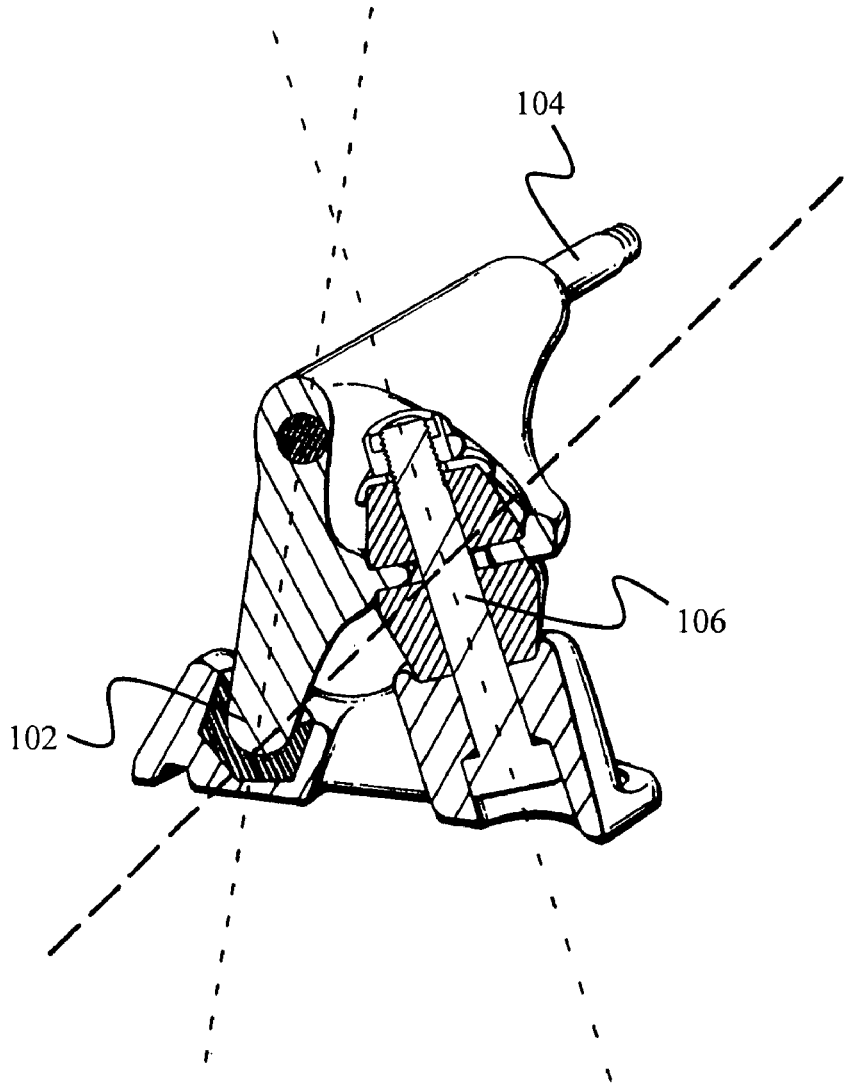
FIG. 1 is a cut-away cross-sectional illustration of a traditional truck.

As shown in FIG. 1, a traditional skateboard truck 100 uses a pin 102-axle 104-kingpin 106 configuration. While functional for simply turning, the pin 102-axle 104-kingpin 106 configuration produces a twisting turn with little if any lateral movement. When a user focuses weight on one edge of the skateboard (i.e., as opposed to the other edge), the truck will produce the twisting turn which simply turns the skateboard in the desired direction.

Figure 2:
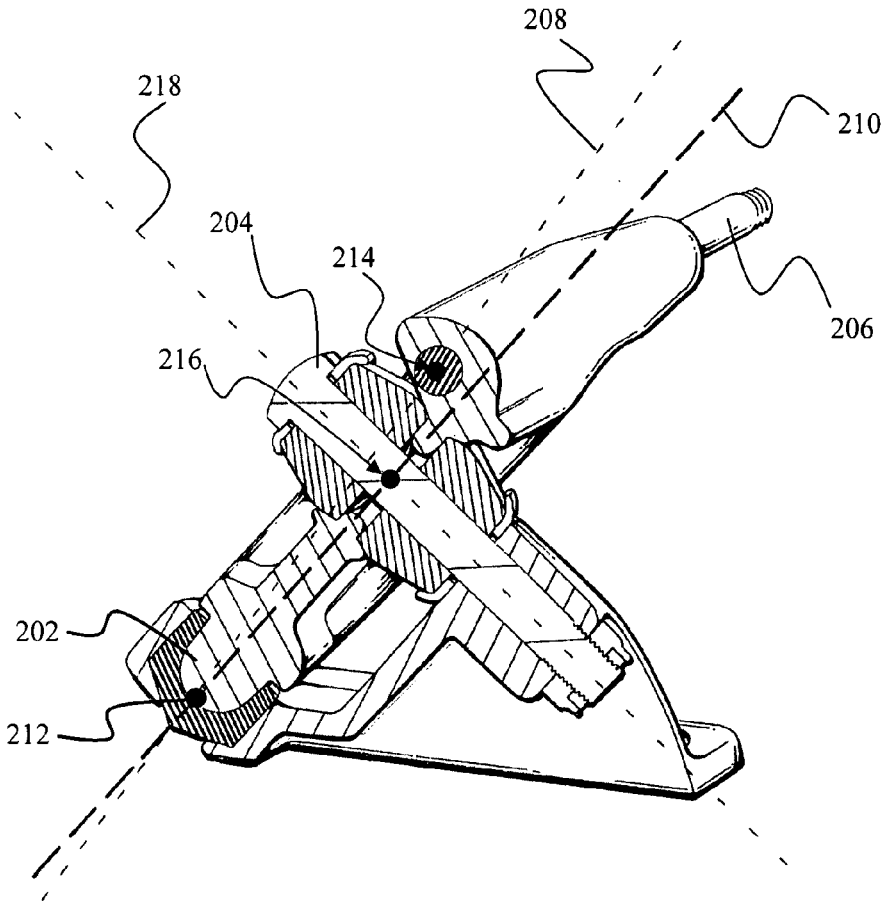
FIG. 2 is a cut-away cross-sectional illustration of another aspect of a prior art truck.

As an alternative design and as shown in FIG. 2, another skateboard truck 200 has been devised that utilizes a pin 202-kingpin 204-axle 206 configuration, with the kingpin 204 positioned substantially perpendicular to the pin-axle axis 208 and the pin-kingpin axis 210. The pin-axle axis 208 runs from a tip 212 of the pin 202 to a center point 214 of the axle 206. The pin-kingpin axis 210 runs from the tip 212 of the pin 202 through a midpoint 216 of the kingpin 204. In this configuration, the pin-axle axis 208 is positioned between the kingpin-axis 218 and the pin-kingpin axis 210, also resulting in a simple twisting turn with little, if any, lateral movement.

The prior art is to be contrasted with the present invention, where the kingpin is not perpendicular to the pin-kingpin or pin-axle axes, but rather is positioned substantially perpendicular to an attached skateboard. This configuration causes a side-to-side movement as well as a rotational movement of the pin. The side-to-side range projects the axle outwards (i.e., outward projection) from the inside of the turn, putting the rider's weight farther into the turn and thereby lowering the center of gravity and lateral angulature of the deck. The new configuration creates the opportunity for extended range, which results in additional turning capabilities. The outward projection also creates forward propulsion, caused by the displacement of the wheels perpendicular to the direction of travel. The present invention is discussed in further detail in the following section.

(2) Detailed Description

Figure 3:
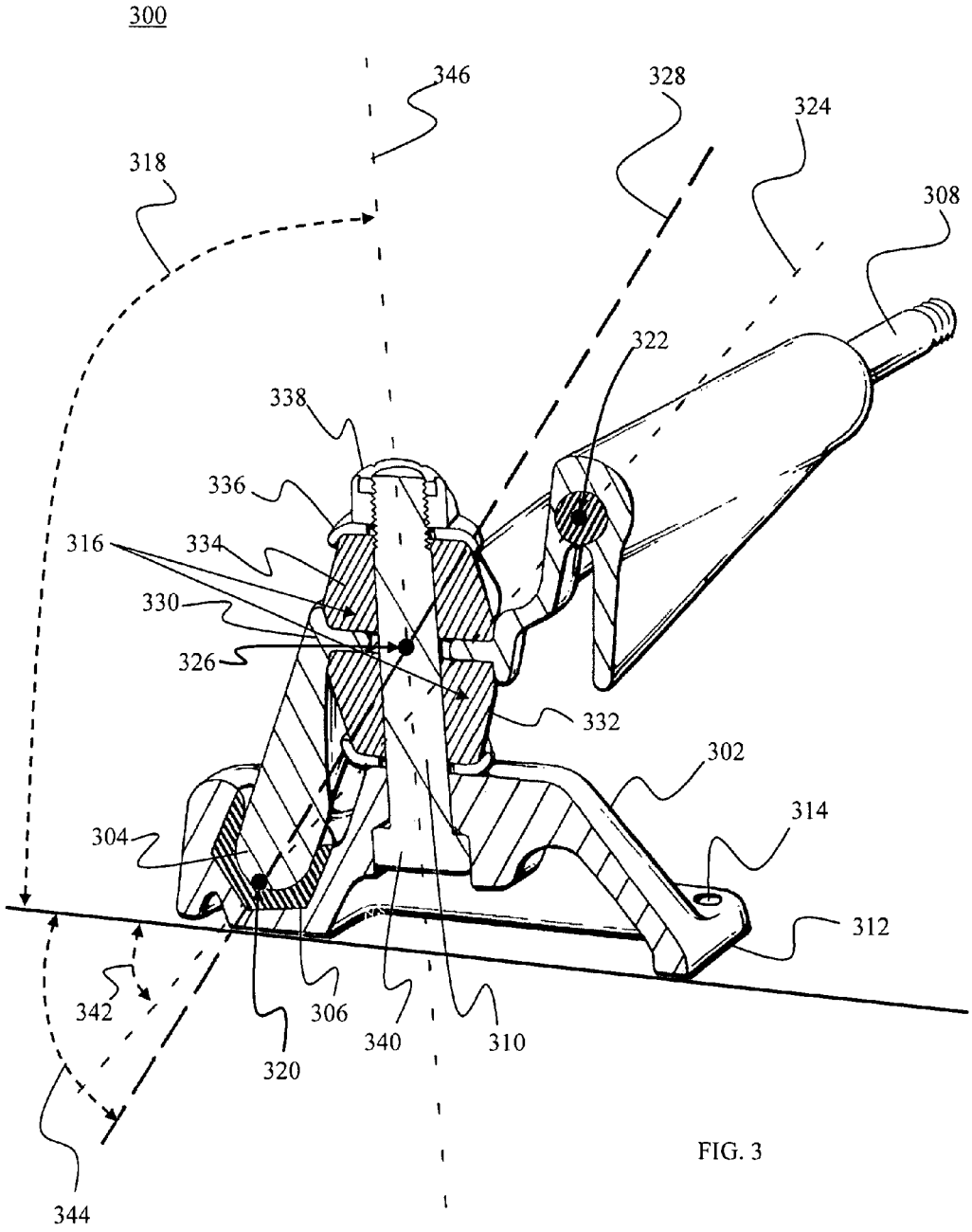
FIG. 3 is a cut-away cross-sectional illustration of a truck with a pin-kingpin-axle configuration according to the present invention.

FIG. 3 is a cut-away cross-sectional view of the skateboard truck 300 of the present invention. As shown in FIG. 3, the truck 300 comprises a base plate 302 for attaching with a skateboard. A pivot pin 304 rests within a cup 306 of the base plate 302, pivotally coupling the pivot pin 304 with the base plate 302. An axle 308 is coupled with the base plate 302 by a kingpin 310 secured with the axle 308.

The base plate 302 is a casting of any suitable construction and made of any suitably rigid material. As a non-limiting example, the base plate 302 is cast in A356 prime aircraft grade aluminum and heat treated to Rockwell T-6. In alternative embodiments, the base plate 302 may be cast or forged of any formable high-strength metal or plastic.

The base plate 302 further comprises a base 312. The base 312 is formed in a suitable shape for attaching with a skateboard. As a non-limiting example, the base 312 is a substantially rectangular plate having a finite thickness, for example about 3/16 inches, and a plurality of apertures 314. The apertures 314 are suitably configured for mounting the base plate 302 onto the underside of the skateboard platform.

The kingpin 310 is positioned between the axle 308 and the pivot pin 304. A resilient bushing 316 is circumferentially disposed about the kingpin 310 for providing a skateboard truck pivot axis (i.e., axis of rotation) relative to the axle 308. This configuration of pin 304-kingpin 310-axle 308 places the axle 308 as far from the spring union (i.e., resilient bushings 316) as possible, maximizing the distance deflected given the limitations of standard sized bushing and their deflection range.

Further, the kingpin 310 is attached with the base plate 302 such that it is positioned substantially perpendicular relative to a skateboard deck. For example, the kingpin 310 may be positioned at an angle 318 ranging from about 70° to about 105° relative to the skateboard deck. This novel kingpin 310 configuration requires less force to deflect the bushings 316 than the prior art. As such, steepening the angle (i.e., configuring it substantially perpendicular to the skateboard) allows for an increased range of axle deflection which contributes to more turning capability and smoother turning action. The near verticality of the kingpin 310 of the present invention allows for more range than that of the prior art, shown in FIG. 2. Several of the special properties derived from the geometry of the present invention occur at the outer ranges of the movement and, as such, the overly angled kingpins of the prior art (i.e., shown in FIG. 2) restrict the range. The pivot pin 304 can be of any suitable construction and made of any suitable material. As a non-limiting example, the pivot pin 304 is cast in A356 prime aircraft grade aluminum and heat treated to Rockwell T-6. In alternative embodiments the pivot pin 304 may be cast or forged of any formable high-strength metal or plastic.

The pivot pin 304 includes a tip 320 and the axle 308 includes a center point 322, such that a pin-to-axle axis 324 runs from the tip 320 of the pivot pin 304 to the center point 322 of the axle 308. Furthermore, the kingpin 310 has a midpoint 326, such that a pin-to-kingpin axis 328 runs from the tip 320 of the pivot pin 304 through the midpoint 326 of the kingpin 310. The kingpin 310 can be attached with the base plate 302 in a variety of ways and with a variety of bushings 316 to form the midpoint 326. As a non-limiting example, the midpoint 326 is where two bushings 316 come together with a seat plate 330. In this configuration, when assembled, the kingpin 310 extends through a first bushing 332 disposed between the bushing seat plate 330 and the base plate 302. The kingpin 310 further extends through a second bushing 334 and a washer 336, and is fastened with a fastening nut 338. The kingpin 310, bushing seat plate 330, nut 338, and washer 336 are formed of any suitable type of construction and made of any suitable material. In a preferred embodiment, the kingpin 310, nut 338, and washer 336 are fabricated from steel having conventional dimensions, for example, about ⅜ inches in diameter. Additionally, the first 332 and second 334 bushings are formed of a suitably flexible material, a non-limiting example of which includes urethane.

The compliant properties of the bushings 316 allow the axle 308 to pivot about the pin-to-kingpin axis 328 when a sufficient load is applied to an end portion of the axle 308. As such, the axle 308 functions as a first resilient pivoting member. As will be recognized by one skilled in the art, the mounting of the axle 308 to the base plate 302 can be modified as desired. For example, a system using a pair of compression springs, as described in U.S. Pat. No. 5,263,725 to Gesmer et al., may be used instead of the urethane bushing system.

The bolt head 340 of the kingpin 310 is displaced on the underside of the base 302, such that the kingpin 310 does not rotate as the nut 338 engages a threaded portion of kingpin 310.

Each of the pin-to-kingpin 328 and the pin-to-axle 324 axes are inclined at an angle relative to an attached skateboard deck. The pin 304, axle 308, and base plate 302 are formed such that the angle of the pin-to-kingpin axis 328 is greater than the angle of the pin-to-axle axis 324 relative to an attached skateboard deck. As a non-limiting example, the pin-to-axle axis 324 is inclined at a pin-to-axle angle 342 ranging from about 35° to about 55°, and the pin-to-kingpin axis 328 is inclined at a pin-to-kingpin angle 344 ranging from about 40° to about 70°.

Additionally, the pin 304, axle 308, and base plate 302 are formed such that the kingpin midpoint 326 is above the pin-to-axle axis 324, thereby placing the pin-to-kingpin axis 328 between the pin-to-axle axis 324 and the kingpin axis 346 (i.e., the kingpin axis 346 runs the length of the kingpin 310 and through the kingpin midpoint 326). The skateboard truck 300 of the present invention is to be contrasted with the prior art skateboard truck 200 of FIG. 2, where the kingpin midpoint 216 is positioned below the pin-to-axle axis 208, thereby placing the pin-to-axle axis 208 between the pin-to-kingpin axis 210.

Figure 4:
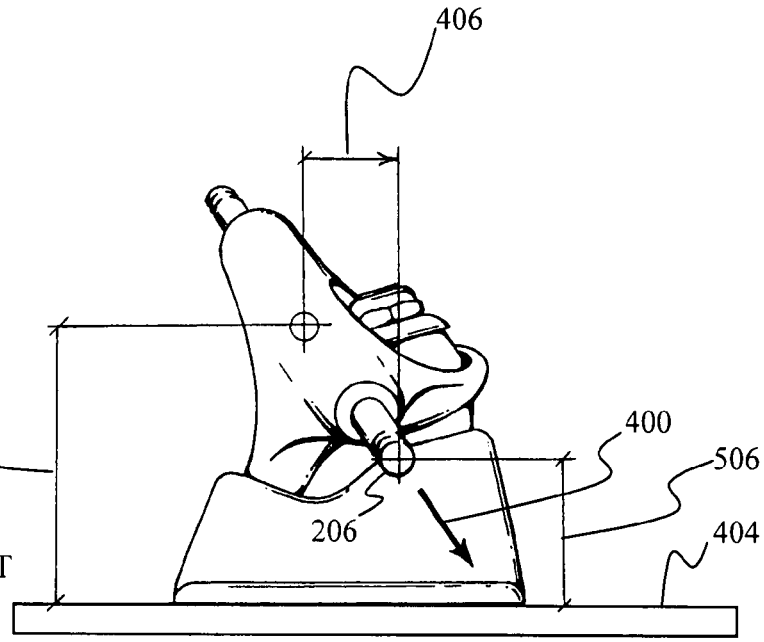
PRIOR ART FIG. 4
FIG. 4 is side view illustration of a traditional truck, showing range of movement of the traditional truck.
Figure 5:
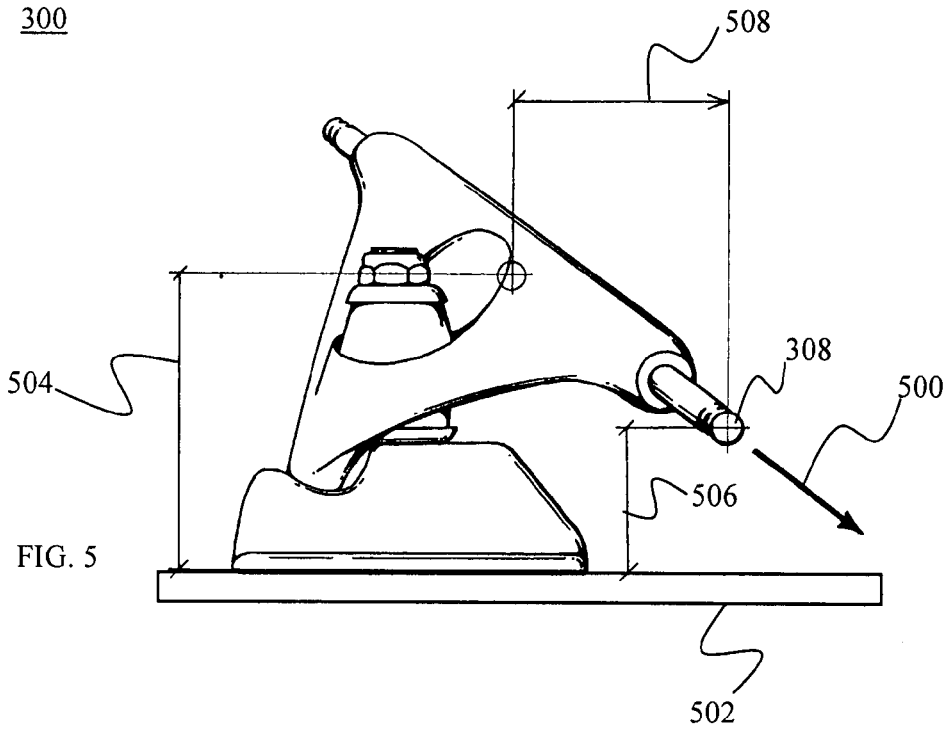
FIG. 5 is a side view illustration of a truck according to the present invention, showing range of movement of the truck.

FIGS. 4 and 5 are side view illustrations showing movement of the skateboard trucks of the prior art and that of the present invention respectively. FIGS. 4 and 5 compare the direction and range of movement for the two trucks. As shown in FIG. 4, the prior art 200 configuration forces movement 400 of the axle 206 almost directly toward an attached skateboard deck 404, which limits the range of turning. This is to be contrasted with the present invention, as shown in FIG. 5, where the unique configuration described herein forces movement 500 of the axle 308 at a farther point toward an attached skateboard deck 502. As can be seen by comparing the two figures, as the respective axles extend to their full range of motion, they each share approximately the same starting 504 and finishing 506 heights of the axle. However, the prior art axle displacement 406 is substantially less than the present invention axle displacement 508.

The increased displacement 508 of the axle of the present invention provides the truck 300 with the larger range of movement 500 (i.e., hyperturn as defined below) that can be seen in FIG. 5. When the board 502 is laterally deflected, the raised seat pushes against the pin laterally so as to displace the axle farther over, as shown in FIG. 5. Accordingly, not only does the axle twist along the pin-to-axle line, but the axle can also displace side-to-side as it swings around the pin-to-kingpin axis. This lateral movement creates thrust by pushing against the resistance of forward travel and momentum.

FIGS. 6A through 7B are front view illustrations of the prior art and the present invention, respectively, attached with a skateboard deck. As shown in FIGS. 6A and 6B, lateral deflection 600 of the skateboard deck 402 causes the axle to twist 602 almost directly toward the skateboard deck 402. The prior art 200 is to be contrasted with the present invention 300 as shown in FIGS. 7A and 7B, where upon lateral deflection 700 of the skateboard deck, the truck not only twists 702 the axle toward 702 the skateboard deck 502, but also thrusts the wheels outward in a form of lateral truck displacement 704 (i.e., arc-of-sway 704), thereby creating a hyperturn (i.e., the twist 702 combined with the arc-of-sway 704). It should be noted that because of the hyperturn 704, the lateral deflection 700 of the skateboard deck when using the present invention 300, exceeds that of the prior art 200, allowing a user to lean further into turns.

The hyperturn abilities allow the skateboard truck to propel the skateboard forward within the movement of turning. The board can be pumped, and then driven forward. Lateral displacement allows a user to push off from the momentum of the trajectory direction line, then push off from the speed itself to create more speed. This is similar to an ice skater pushing off with alternating feet. The special geometry of the present invention creates a lateral thrust beyond that available from the use of conventional trucks. Conventional trucks have very little thrust, with inaccessible drive properties (i.e., past an usable threshold). The thrust of the present invention is made accessible via heel-toe rail deflection of the kingpin, and twist of the upper body towards the turn. By properly controlling these driving forces, the rider can propel the board forward.

Figures 8A, 8B:
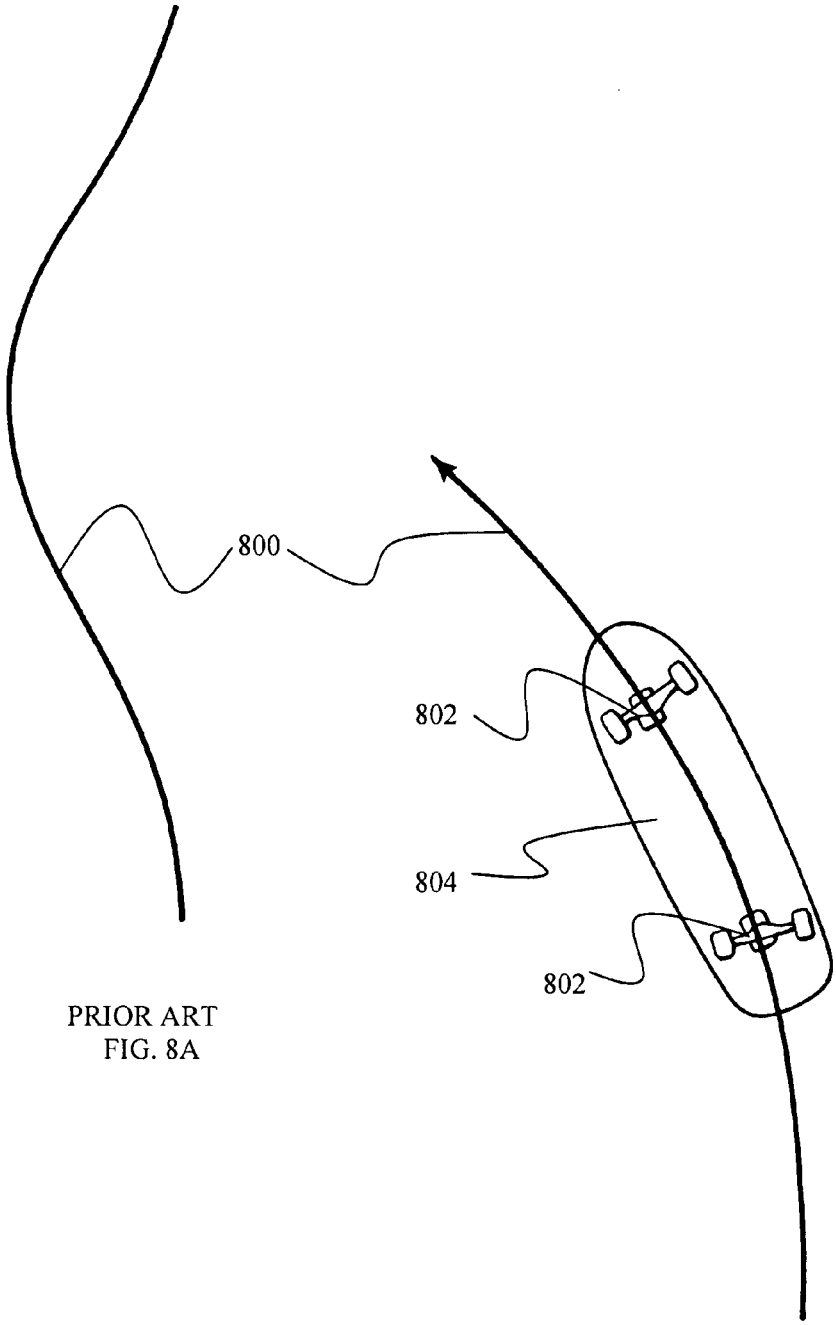
FIG. 8A PRIOR ART
FIG. 8A is an illustration of a path provided by a traditional skateboard truck.
FIG. 8B is an illustration of a path provided by a traditional skateboard truck.

FIG. 8A is an illustration of a skateboard path 800 using a pair of conventional trucks 802, while FIG. 8B is a bottom view illustration of skateboard 804 with conventional trucks 802 traversing the path 800. Skateboards 804 using a pair of conventional trucks 802 turn together at a constant rate along a primary sinusoidal path 800. Both the front and rear trucks pivot in two dimensions symmetrically and in a fixed relation, as shown in FIG. 8B.

Figures 9A, 9B:
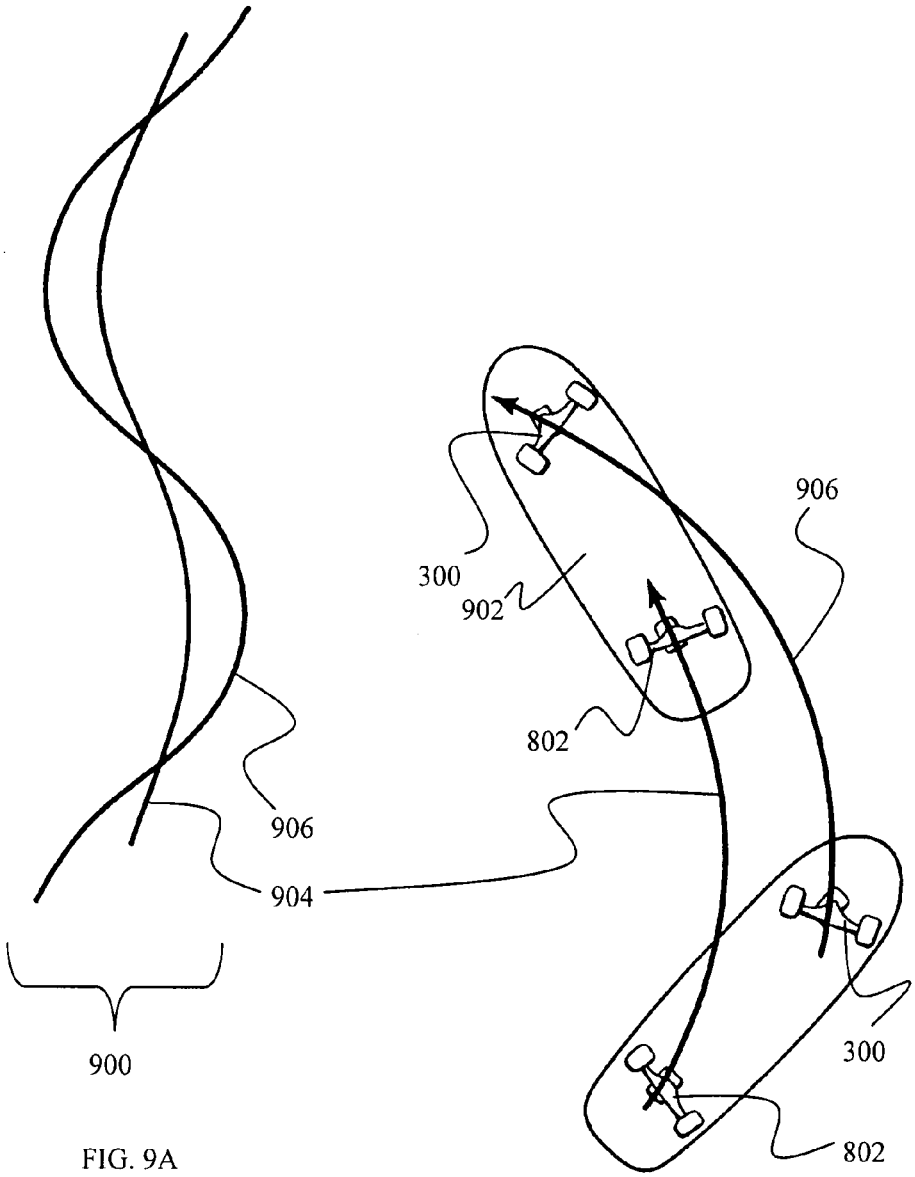
FIG. 9A is an illustration of a path provided by the skateboard truck according to the present invention.
FIG. 9B is an illustration of a path provided by the skateboard truck according to the present invention.

Because of the hyperturn, the present invention also provides a sinusoidal drive where the front truck turns sharper than the back truck. Referring to FIGS. 9A and 9B, FIG. 9A illustrates a path 900 of a skateboard using a truck according to the present invention, while FIG. 9B is a bottom view of a skateboard 902 traversing the path 900 while utilizing an improved front truck 300 according to the present invention, in combination with a conventional rear truck 802. According to this embodiment, as shown in FIGS. 9A and 9B, the rear conventional truck 802 turns on the primary path 904, while simultaneously, the front tuck 300 turns on a secondary sinusoidal path 906. As a result, the skateboard 902 traces a variable parabolic path. The front and rear trucks of the skateboard pivot asymmetrically, as the rear truck pivots primarily in two dimensions and the front truck pivots in three dimensions (to be contrasted with the fixed relation provided by a skateboard utilizing a pair of conventional trucks). The asymmetric properties of the improved skateboard enable the front and rear trucks to turn independently, allowing a skateboard rider to create a variable arc of turn with all wheels in contact with the ground, while propelling the skateboard forward.

(3) Conclusion

The skateboard truck coordinates the principles of movement in a novel manner. The truck described herein includes a pin-kingpin-axle configuration, where the kingpin is positioned substantially perpendicular to an attached skateboard deck. The kingpin has a midpoint that is raised and forward of the pin-to-axle axis. The truck is configured such that a pin-to-kingpin axis is between both the kingpin axis and the pin-to-axle axis. After being attached with a skateboard, the skateboard truck of the present invention creates a new movement with a forward thrust.

What is claimed is:

1. A skateboard truck comprising:

a base plate for attaching with a skateboard deck;

a pivot pin pivotally attached with the base plate, the pivot pin having a tip;

an axle connected with the pivot pin, the axle having a center point, and where a pin-axle axis runs from the pivot pin tip through the center point of the axle;

a kingpin coupling the axle with the base plate, where the kingpin has a midpoint and a length, with a kingpin axis running the length of the kingpin and through the midpoint, and where the kingpin midpoint is positioned between the axle and the pivot pin, and where a pin-kingpin axis runs from the pivot pin tip through the midpoint of the kingpin;

a resilient bushing circumferentially disposed about the kingpin for providing a skateboard truck pivot axis; and wherein the pivot pin and the axle are configured such that the pin-kingpin axis is between the kingpin axis and the pin-axle axis, whereby the skateboard truck with the kingpin positioned between the axle and the pivot pin and configured such that the pin-kingpin axis is between the pin-axle axis and the kingpin axis provides a user with range of movement about two axes of rotation.

2. A skateboard truck as set forth in claim 1, wherein the kingpin is positioned such that it would be substantially perpendicular to an attached skateboard deck.

3. A skateboard truck as set forth in claim 2, wherein each of the pin-to-kingpin and pin-to-axle axes are inclined at an angle relative to an attached skateboard deck, such that an angle of the pin-to-kingpin axis is greater than the angle of the pin-to-axle axis relative to an attached skateboard deck.

4. A skateboard truck as set forth in claim 3, wherein the kingpin is positioned at an angle ranging from about 70° to about 105° relative to an attached skateboard deck.

5. A skateboard truck as set forth in claim 4, wherein the pin-to-axle axis is inclined at an angle ranging from about 35° to about 55°.

6. A skateboard truck as set forth in claim 5, wherein the pin-to-kingpin axis is inclined at an angle ranging from about 40° to about 70°.

7. A skateboard truck as set forth in claim 1, wherein each of the pin-to-kingpin and pin-to-axle axes are inclined at an angle relative to an attached skateboard deck, such that an angle of the pin-to-kingpin axis is greater than the angle of the pin-to-axle axis relative to an attached skateboard deck.

8. A skateboard truck as set forth in claim 7, wherein the kingpin is positioned at an angle ranging from about 70° to about 105° relative to an attached skateboard deck.

9. A skateboard truck as set forth in claim 7, wherein the pin-to-axle axis is inclined at an angle ranging from about 35° to about 55°.

10. A skateboard truck as set forth in claim 7, wherein the pin-to-kingpin axis is inclined at an angle ranging from about 40° to about 70°.

11. A method for forming a skateboard truck, the method comprising acts of:

forming a base plate for attaching with a skateboard deck;

pivotally attaching a pivot pin with the base plate, the pivot pin having a tip;

connecting an axle with the pivot pin, the axle having a center point, and where a pin-axle axis runs from the pivot pin tip through the center point of the axle;

coupling the axle with the base plate using a kingpin, where the kingpin has a midpoint and a length, with a kingpin axis running the length of the kingpin and through the midpoint, and where the kingpin midpoint is positioned between the axle and the pivot pin, and where a pin-kingpin axis runs from the pivot pin tip through the midpoint of the kingpin;

circumferentially disposing a resilient bushing about the kingpin for providing a skateboard truck pivot axis; and configuring the pivot pin and axle such that the pin-kingpin axis is between the kingpin axis and the pin-axle axis, whereby the skateboard truck with the kingpin positioned between the axle and the pivot pin and configured such that the pin-kingpin axis is between the pin-axle axis and the kingpin axis provides a user with range of movement about two axes of rotation.

12. A method for forming a skateboard truck as set forth in claim 11, wherein in the act of coupling the axle with the base plate using a kingpin, the kingpin is positioned such that it would be substantially perpendicular to an attached skateboard deck.

13. A method for forming a skateboard truck as set forth in claim 12, wherein in the act of configuring the pivot pin and axle, each of the pin-to-kingpin and pin-to-axle axes are inclined at an angle relative to an attached skateboard deck, such that an angle of the pin-to-kingpin axis is greater than the angle of the pin-to-axle axis relative to an attached skateboard deck.

14. A method for forming a skateboard truck as set forth in claim 13, wherein in the act of coupling the axle with the base plate using a kingpin, the kingpin is positioned at an angle ranging from about 70° to about 105° relative to an attached skateboard deck.

15. A method for forming a skateboard truck as set forth in claim 14, wherein in the act of configuring the pivot pin and axle, the pin-to-axle axis is inclined at an angle ranging from about 35° to about 55°.

16. A method for forming a skateboard truck as set forth in claim 15, wherein in the act of configuring the pivot pin and axle, the pin-to-kingpin axis is inclined at an angle ranging from about 40° to about 70°.

17. A method for forming a skateboard truck as set forth in claim 11, wherein in the act of configuring the pivot pin and axle, each of the pin-to-kingpin and pin-to-axle axes are inclined at an angle relative to an attached skateboard deck, such that an angle of the pin-to-kingpin axis is greater than the angle of the pin-to-axle axis relative to an attached skateboard deck.

18. A method for forming a skateboard truck as set forth in claim 11, wherein in the act of coupling the axle with the base plate using a kingpin, the kingpin is positioned at an angle ranging from about 70° to about 105° relative to an attached skateboard deck.

19. A method for forming a skateboard truck as set forth in claim 11, wherein in the act of configuring the pivot pin and axle, the pin-to-axle axis is inclined at an angle ranging from about 35° to about 55°.

20. A method for forming a skateboard truck as set forth in claim 11, wherein in the act of configuring the pivot pin and axle, the pin-to-kingpin axis is inclined at an angle ranging from about 40° to about 70°.

21. A skateboard comprising:

a skateboard deck;

a first truck attached with the skateboard deck; and a second truck attached with the skateboard deck, the second truck comprising:

a base plate attached with the skateboard deck;

a pivot pin pivotally attached with the base plate, the pivot pin having a tip;

an axle connected with the pivot pin, the axle having a center point, and where a pin-axle axis runs from the pivot pin tip through the center point of the axle;

a kingpin coupling the axle with the base plate, where the kingpin has a midpoint and a length, with a kingpin axis running the length of the kingpin and through the midpoint, and where the kingpin midpoint is positioned between the axle and the pivot pin, and where a pin-kingpin axis runs from the pivot pin tip through the midpoint of the kingpin;

a resilient bushing circumferentially disposed about the kingpin for providing a skateboard truck pivot axis;

wherein the pivot pin and the axle are configured such that the pin-kingpin axis is between the kingpin axis and the pin-axle axis, whereby the second skateboard truck with the kingpin positioned between the axle and the pivot pin and configured such that the pin-kingpin axis is between the pin-axle axis and the kingpin axis provides a user with range of movement about two axes of rotation.

22. A skateboard as set forth in claim 21, wherein the first truck has a pin, axle and kingpin, and is configured such that the axle is between the pin and kingpin.

23. A method for forming a skateboard, the method comprising acts of:

attaching a first truck with a skateboard deck; and attaching a second truck with a skateboard deck, the second truck comprising:

a base plate attached with the skateboard deck;

a pivot pin pivotally attached with the base plate, the pivot pin having a tip;

an axle connected with the pivot pin, the axle having a center point, and where a pin-axle axis runs from the pivot pin tip through the center point of the axle;

a kingpin coupling the axle with the base plate, where the kingpin has a midpoint and a length, with a kingpin axis running the length of the kingpin and through the midpoint, and where the kingpin midpoint is positioned between the axle and the pivot pin, and where a pin-kingpin axis runs from the pivot pin tip through the midpoint of the kingpin;

a resilient bushing circumferentially disposed about the kingpin for providing a skateboard truck pivot axis;

wherein the pivot pin and the axle are configured such that the pin-kingpin axis is between the kingpin axis and the pin-axle axis, whereby the second skateboard truck with the kingpin positioned between the axle and the pivot pin and configured such that the pin-kingpin axis is between the pin-axle axis and the kingpin axis provides a user with range of movement about two axes of rotation.

* * * * *